US010987550B2

(12) United States Patent
Kato

(10) Patent No.: US 10,987,550 B2
(45) Date of Patent: Apr. 27, 2021

(54) GOLF CLUB HEAD AND METHOD OF MANUFACTURING SAME

(71) Applicant: Sumitomo Rubber Industries, Ltd., Hyogo (JP)

(72) Inventor: Masatoshi Kato, Kobe (JP)

(73) Assignee: Sumitomo Rubber Industries, Ltd., Hyogo (JP)

( * ) Notice: Subject to any disclaimer, the term of this patent is extended or adjusted under 35 U.S.C. 154(b) by 0 days.

(21) Appl. No.: 16/578,508

(22) Filed: Sep. 23, 2019

(65) Prior Publication Data

US 2020/0094116 A1 Mar. 26, 2020

(30) Foreign Application Priority Data

Sep. 26, 2018 (JP) ..... JP2018-180782

(51) Int. Cl.
*A63B 53/04* (2015.01)
*B21K 17/00* (2006.01)

(52) U.S. Cl.
CPC ..... *A63B 53/0466* (2013.01); *B21K 17/00* (2013.01); *A63B 53/0408* (2020.08); *A63B 53/0433* (2020.08)

(58) Field of Classification Search
CPC ..... A63B 2053/0491
USPC ..... 473/324–350
See application file for complete search history.

(56) References Cited

U.S. PATENT DOCUMENTS 5,056,705 A * 10/1991 Wakita ..... A63B 53/04 228/176
5,851,160 A * 12/1998 Rugge ..... A63B 53/04 473/349
5,935,019 A * 8/1999 Yamamoto ..... A63B 53/04 473/338
5,961,394 A * 10/1999 Minabe ..... A63B 53/04 473/305
5,967,905 A * 10/1999 Nakahara ..... A63B 53/04 473/345
6,062,988 A * 5/2000 Yamamoto ..... A63B 53/04 473/324
6,099,414 A * 8/2000 Kusano ..... A63B 53/047 473/342
6,206,789 B1 * 3/2001 Takeda ..... A63B 53/04 473/335
6,254,494 B1 * 7/2001 Hasebe ..... A63B 53/04 473/349

(Continued)

FOREIGN PATENT DOCUMENTS

JP 04082575 A * 3/1992
JP 06335540 A * 12/1994

(Continued)

*Primary Examiner* — Alvin A Hunter
(74) *Attorney, Agent, or Firm* — Studebaker & Brackett PC

(57) ABSTRACT

A golf club head has an inner cavity and comprises a face member and a head main body which a front opening, which are connected to each other. The head main body comprises a sole portion, and a weight member which has a specific gravity greater than that of the head main body is fixed to an inner surface of the sole portion. A weld which fix the weight member to the sole portion is disposed at the peripheral edge of the weight member. The weight member has the width in the toe-heel direction of the head, which is smaller on its rear side than its front side.

17 Claims, 10 Drawing Sheets

(56) References Cited

U.S. PATENT DOCUMENTS 6,319,149 B1 * 11/2001 Lee ..... A63B 53/04 473/342
6,364,788 B1 * 4/2002 Helmstetter ..... A63B 53/02 473/324
6,371,868 B1 * 4/2002 Galloway ..... A63B 53/0466 473/324
6,435,978 B1 * 8/2002 Galloway ..... C23F 1/26 473/305
6,524,198 B2 * 2/2003 Takeda ..... A63B 53/02 473/338
6,776,723 B2 * 8/2004 Bliss ..... A63B 60/00 473/291
6,821,214 B2 * 11/2004 Rice ..... A63B 60/02 473/345
6,932,718 B2 * 8/2005 Nishitani ..... A63B 53/04 473/345
7,056,228 B2 * 6/2006 Beach ..... A63B 53/0466 473/345
7,258,629 B2 * 8/2007 Chen ..... A63B 53/0466 473/342
7,326,472 B2 * 2/2008 Shimazaki ..... A63B 53/0466 428/682
7,351,163 B2 * 4/2008 Shimazaki ..... A63B 53/0466 473/345
7,367,900 B2 * 5/2008 Kumamoto ..... A63B 53/0466 473/345
7,455,600 B2 * 11/2008 Imamoto ..... A63B 60/02 473/345
7,563,175 B2 * 7/2009 Nishitani ..... A63B 53/04 473/324
7,651,410 B2 * 1/2010 Shimazaki ..... A63B 53/0466 473/335
7,887,435 B2 * 2/2011 Nishitani ..... A63B 53/04 473/345
8,540,588 B2 * 9/2013 Rice ..... A63B 53/0466 473/334
8,753,226 B2 * 6/2014 Rice ..... A63B 53/0466 473/334
8,858,362 B1 * 10/2014 Leposky ..... A63B 53/0466 473/334
8,876,630 B2 * 11/2014 Takechi ..... A63B 53/047 473/332
8,888,607 B2 * 11/2014 Harbert ..... A63B 53/06 473/307
2015/0045143 A1 2/2015 Abe

FOREIGN PATENT DOCUMENTS

JP 09173512 A * 7/1997
JP 09266964 A * 10/1997
JP 10225538 A * 8/1998 ..... A63B 60/00
JP 10234895 A * 9/1998
JP 11009735 A * 1/1999
JP 11347156 A * 12/1999
JP 2000024144 A * 1/2000 ..... A63B 60/00
JP 2003038689 A * 2/2003
JP 2003093557 A * 4/2003
JP 2003126309 A * 5/2003 ..... A63B 60/02
JP 2013233337 A * 11/2013
JP 5576972 B1 7/2014

* cited by examiner

GOLF CLUB HEAD AND METHOD OF MANUFACTURING SAME

TECHNICAL FIELD

The present invention relates to a golf club head and a method of manufacturing the same.

BACKGROUND ART

Japanese Patent No. 5576972 discloses a hollow golf club head having an inner cavity. This golf club head comprises a face member and a head main body with a front opening, which are fixed to each other by welding.

SUMMARY OF THE INVENTION

Problems to be Solved by the Invention

In recent years, in order to increase the flight distance of a golf ball hit by a golf club head, the golf club head is required to lower the position of the center of gravity of the head. Lowering the position of the center of gravity brings the sweet spot of the club face closer to the club face center (namely, near the actual hitting position), so the launch angle of the hit ball is increased and the ball spin is reduced. Thus, a golf club head whose center of gravity is lowered can increases the flight distance of the hit ball.

In order to lower the position of the center of gravity of a golf club head, it is conceivable to add a weight member to a main body of the head and fix it to a sole portion thereof by welding. The welding may be possible by inserting a welding torch into the head main body through an opening of the head main body.

However, such welding work in a limited space inside the head main body is usually not easy. In particular, as the rear edge of the weight member is located at a deeper position of the head main body from the opening, the position is far from the hand of the welding operator, and the movable range of the welding torch in that location is limited because the head main body is usually formed so as to become smaller toward the rear side in its plan view and side view.

Therefore, there is a problem such that skill is required in order to accurately move the tip of the welding torch along the rear edge of the weight member, and thus productivity is deteriorated. Further, if the welding of the weight member is insufficient, there is a possibility that, by the impact repeatedly applied at the time of hitting a ball, the weight member is detached or abnormal noise is generated.

In view of the above circumstances, the present invention was made, and a primary objective of the present invention is to provide a golf club head and a manufacturing method therefor in which the position of the center of gravity of the head can be lowered without impairing productivity of the head.

According to one aspect of the present invention, a golf club head has an inner cavity and comprises a face member and a head main body with a front opening which are connected to each other, wherein

- the head main body comprises a sole portion,
- a weight member which has a specific gravity greater than that of the head main body is fixed to an inner surface of the sole portion,
- a weld which fixes the weight member to the inner surface of the sole portion is disposed at a peripheral edge of the weight member, and

- the weight member has the width in a toe-heel direction of the head, which is smaller on its rear side than its front side.

According to another aspect of the present invention, a method of manufacturing a golf club head having an inner cavity, comprises the steps of:

- preparing a face member and a head main body which has a front opening and comprises a sole portion,
- preparing a weight member whose specific gravity is greater than that of the head main body and whose width in a toe-heel direction of the head is smaller on its rear side than its front side,
- placing the weight member on an inner surface of the sole portion of the head main body,
- fixing the weight member to the sole portion of the head main body by inserting a welding torch into the inside of the head main body through the front opening of the head main body, and disposing a molten metal at a peripheral edge of the weight member, and
- connecting the face member to the head main body after the fixing of the weight member.

The inner surface of the sole portion may be provided with a recess in which the weight member is disposed.

The weld which fixes the weight member to the sole portion of the head main body may extend from the head main body over a wall of the recess onto the weight member.

The mass of the weight member may be 10% or more of the total mass of the face member and the head main body.

The weight member may be formed in a plate shape having a thickness of not more than 10 mm.

In a plan view of the weight member, the position of the center of gravity of the weight member may be positioned on a club-face side of the midpoint in the front-back direction of the head, of the weight member.

The weight member may have a trapezoidal shape having a large width on the club-face side in the plan view.

The weight member may have a polygonal shape made up of straight sides in the plan view.

Therefore, in the golf club head according to the present invention, as the weight member is fixed to the inner surface of the sole portion of the head main body, the position of the center of gravity is lowered.

By inserting the welding torch into the inside of the head main body through the front opening of the head main body, and disposing the molten metal at the peripheral edge of the weight member, the weld which fixes the weight member to the sole portion can be formed.

Since the rear edge of the weight member is positioned at a location away from the front opening and being narrow. Thus, welding workability is poor in such narrow location in general. But, according to the present invention, the width in the toe-heel direction of the weight member is made smaller on the rear side than the front side, therefore, the deterioration in the productivity of the head can be suppressed.

Thus, according to the present invention, it is possible to provide a golf club head capable of lowering the position of the center of gravity of the head, without impairing the productivity of the head.

DESCRIPTION OF THE PREFERRED EMBODIMENTS

Embodiments of the present invention will now be described in detail in conjunction with accompanying drawings.

Figure 1:
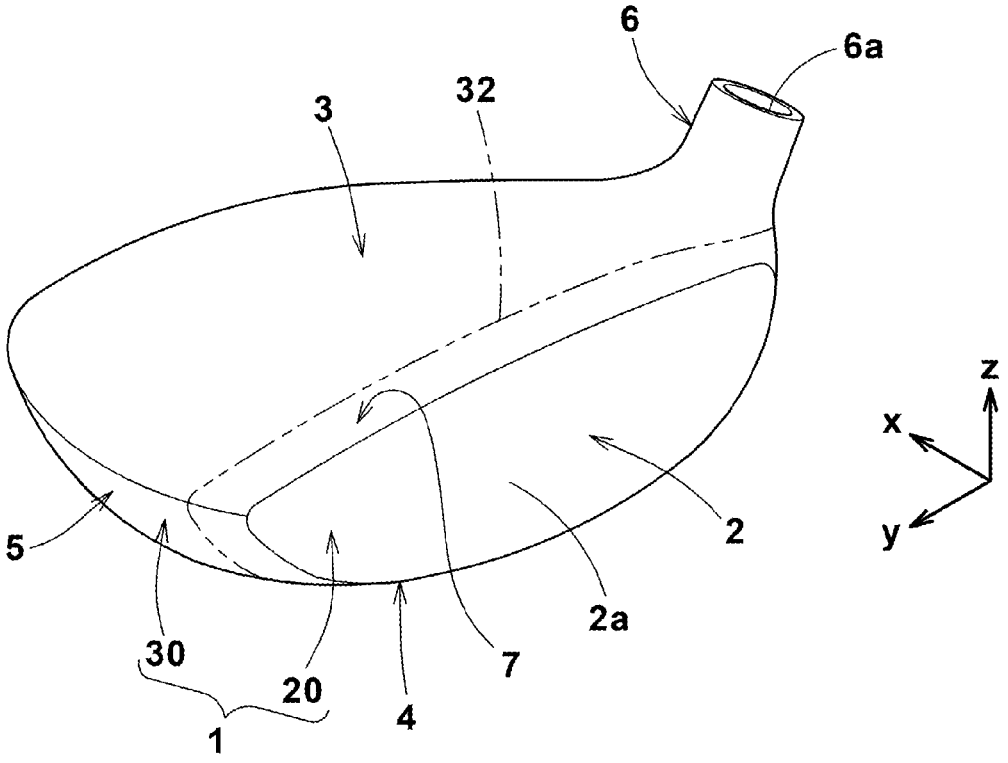
FIG. 1 is a perspective view of a golf club head as an embodiment of the present invention.
Figure 2:
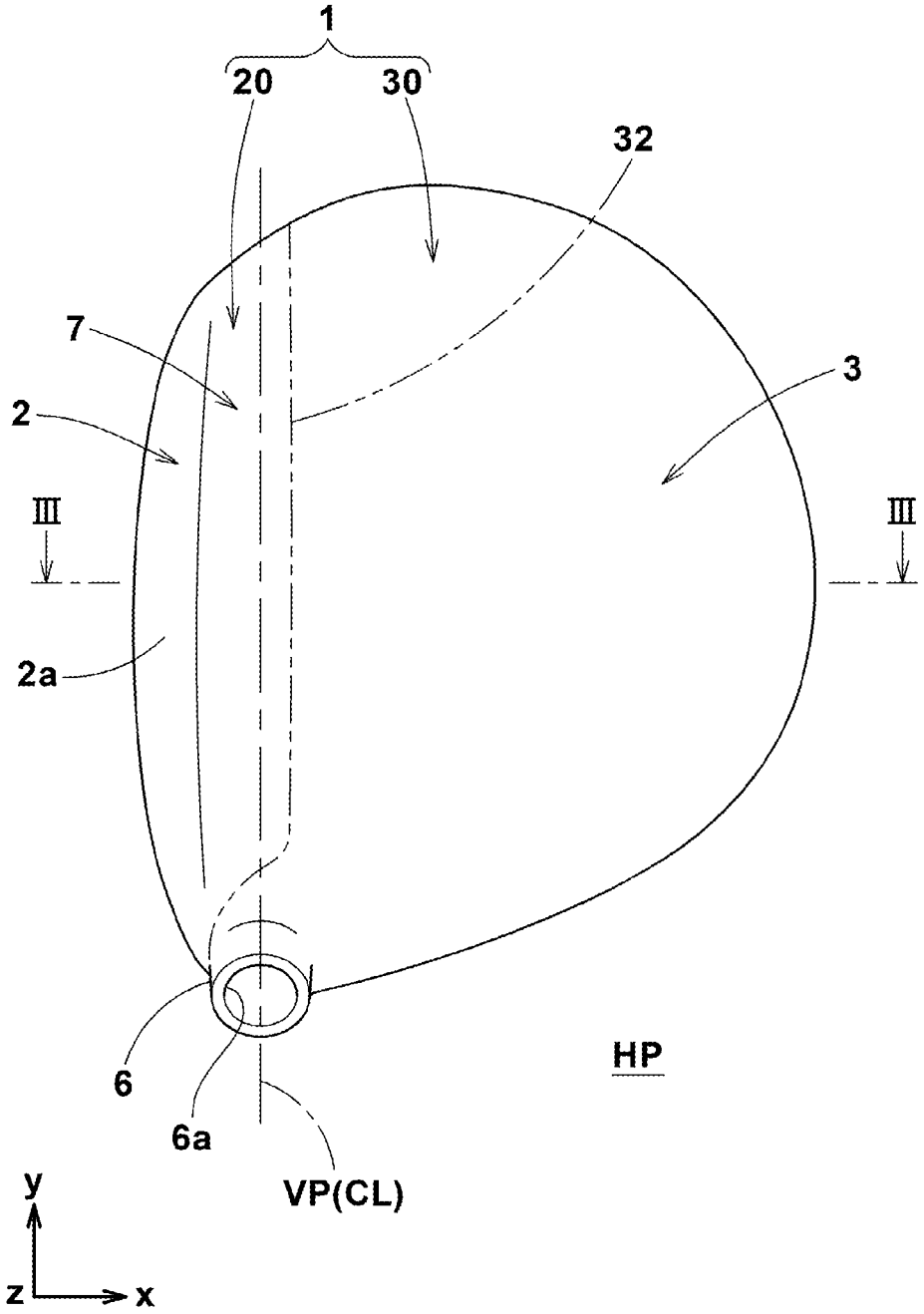
FIG. 2 is a plan view thereof.
Figure 3:
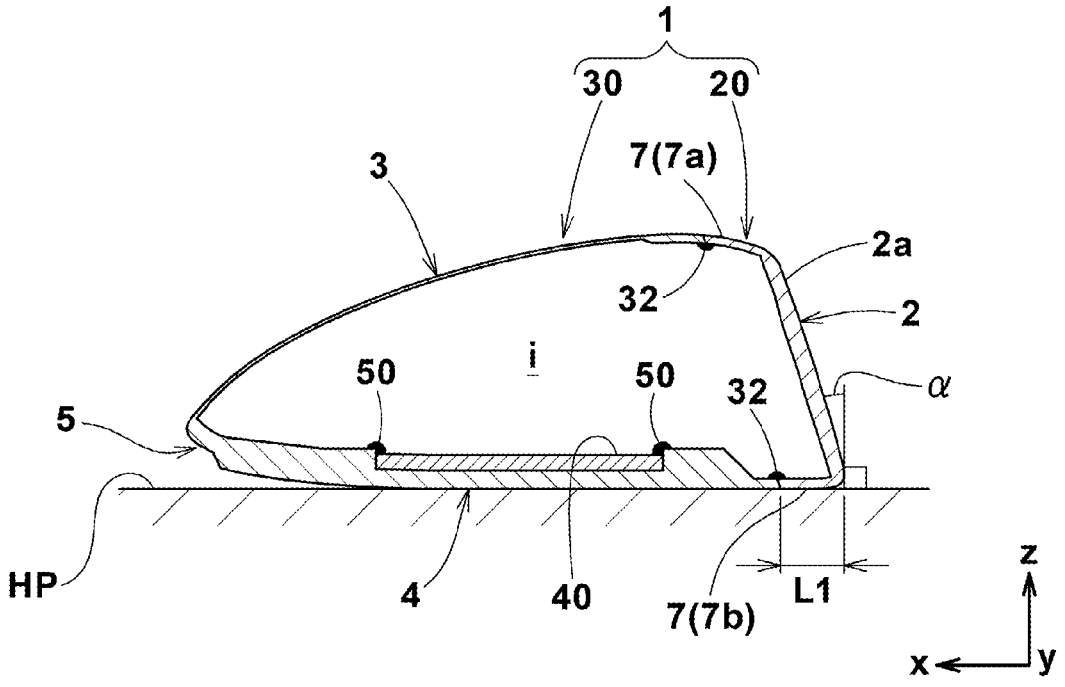
FIG. 3 is a cross-sectional view thereof taken along line III-III in FIG. 2.

FIGS. 1-5 are a perspective view, a plan view, a cross-sectional view, an exploded perspective view and a perspective view, which show a golf club head 1 as an embodiment of the present invention (shortly, the head 1). In FIGS. 1-3, the head 1 under its standard state is shown.

In this application including the description and claims, dimensions, positions, directions and the like relating to the club head refer to those under the standard state of the club head unless otherwise noted.

Here, the standard state of a golf club head is such that the club head is set on a horizontal plane HP so that the central axis CL (shown in FIG. 2) of the golf club shaft (not shown) is inclined at the specified lie angle (not shown) while keeping the central axis CL on a vertical plane VP, and the club face forms the specified loft angle alpha (shown in FIG. 3). Incidentally, in the case of the club head alone, the center line of the shaft inserting hole can be used instead of the central axis of the club shaft.

"Toe-heel direction" of the head is a direction y parallel with the horizontal plane HP and the vertical plane VP.

"Front-back direction" of the head is a direction x parallel with the horizontal plane HP and orthogonal to the vertical plane VP.

"Up-down direction" of the head is a direction z orthogonal to the direction x and the direction y.

The head 1 in this embodiment shown in FIGS. 1 to 5 has as a hollow structure with an inner cavity (i) and is formed in a shape of a typical wood type golf club head in this example. Here, the wood type golf club means at least a driver (#1), a brushy (#2), a spoon (#3), a buffy (#4), and a creek (#5). Further, the head 1 of the present embodiment may include heads having substantially similar shapes to those of the golf clubs listed above even if the club number or name is different from the golf clubs listed above.

As another embodiment of the present invention, the head 1 may be configured as a utility type golf club head.

The head 1 in the present embodiment comprises a face portion 2, a crown portion 3, a sole portion 4 and a side portion 5, and is provided with a weight member 40 disposed therein.

The front surface of the face portion 2 forms a club face 2*a* for hitting a ball.

The crown portion 3 continues from the upper edge of the face portion 2 and forms the upper surface of the head.

The sole portion 4 continues from the lower edge of the face portion 2 and forms the bottom surface of the head.

The side portion 5 connects between the crown portion 3 and the sole portion 4 and forms a side surface of the head, and the toe side edge and the heel side edge of the side portion 5 are connected to the toe side edge and the heel side edge of the face portion 2, respectively.

The head 1 is provided with an inner cavity (i) defined as being surround by the face portion 2, the crown portion 3, the sole portion 4 and the side portion 5.

A neck portion 6 having a shaft insertion hole 6*a* into which a tip end of a club shaft (not shown) is inserted and fixed is formed on the heel side of the crown portion 3 in this example as shown in FIGS. 1 and 2.

The neck portion 6 in this example is formed in a tubular shape protruding upward from the crown portion 3.

Incidentally, the center line CL of the shaft insertion hole 6*a* coincides with the central axis of the club shaft fixed to the head.

The head 1 comprises a face member 20 and a head main body 30, which are connected to each other.

In the present embodiment, the face member 20 is formed in a so-called cup shape whose opening is oriented backward of the head as shown in FIGS. 1 to 5.

The face member 20 comprises the face portion 2 and a turnback 7 extending backward from the peripheral edge of the club face 2*a*. Such face member 20 can be prepared by, for example, casting, plate pressing, forging, or the like.

The face member 20 is made of a metal material. As the metal material, various materials, for example, titanium, titanium alloy, stainless steel and aluminum alloy and the like can be used. In this example, a titanium alloy Ti-8Al-1Mo-1V (specific gravity about 4.2) is used.

The turnback 7 in this example includes a crown side turnback 7*a* which forms a fore part of the crown portion 3, a sole side turnback 7*b* which forms a fore part of the sole portion 4, a toe side turnback 7*c* which forms a fore part of the side portion on the toe side, and a heel side turnback 7*d* which forms a fore part of the side portion on the heel side.

Figure 4:
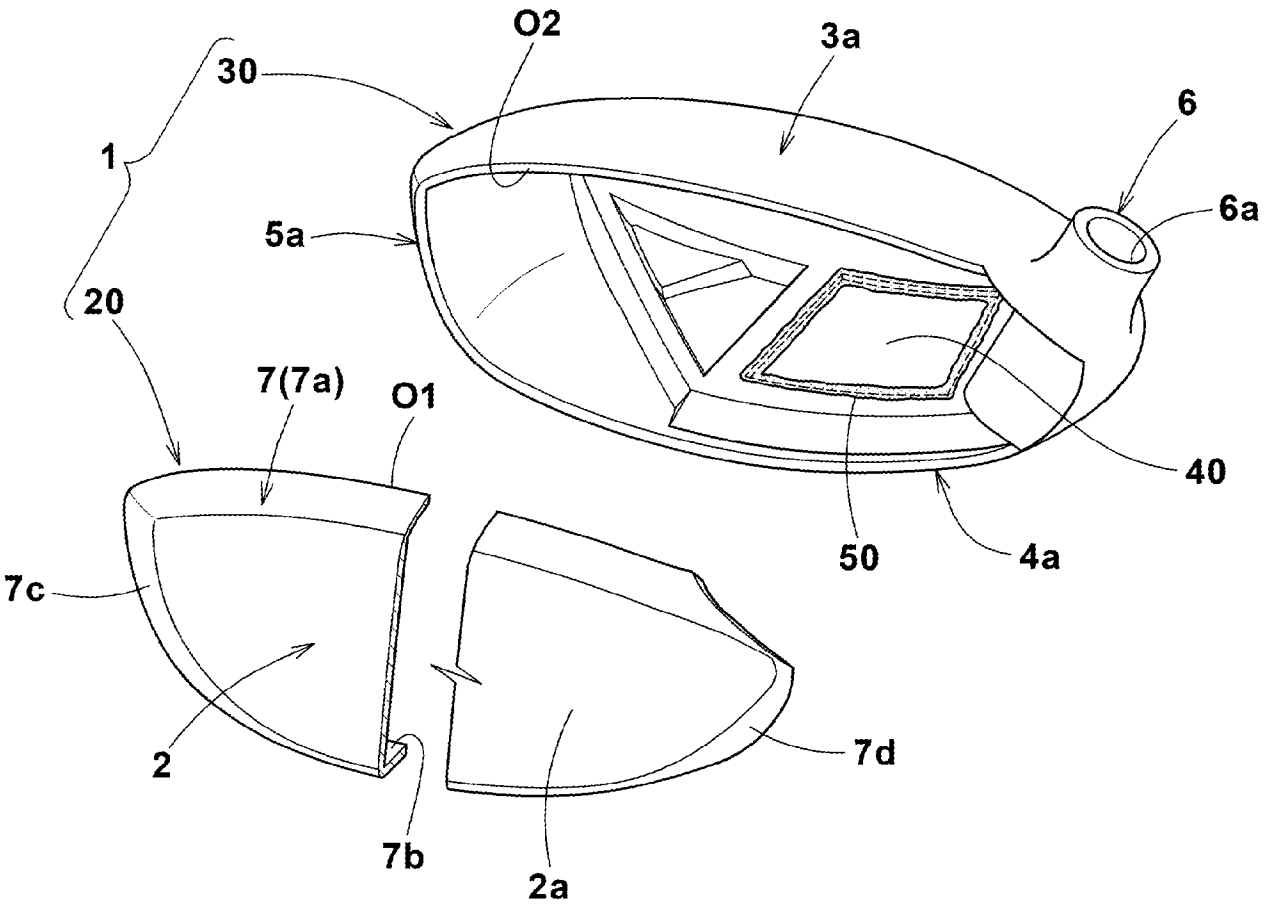
FIG. 4 is an exploded perspective view of the golf club head of the present embodiment.
Figure 5:
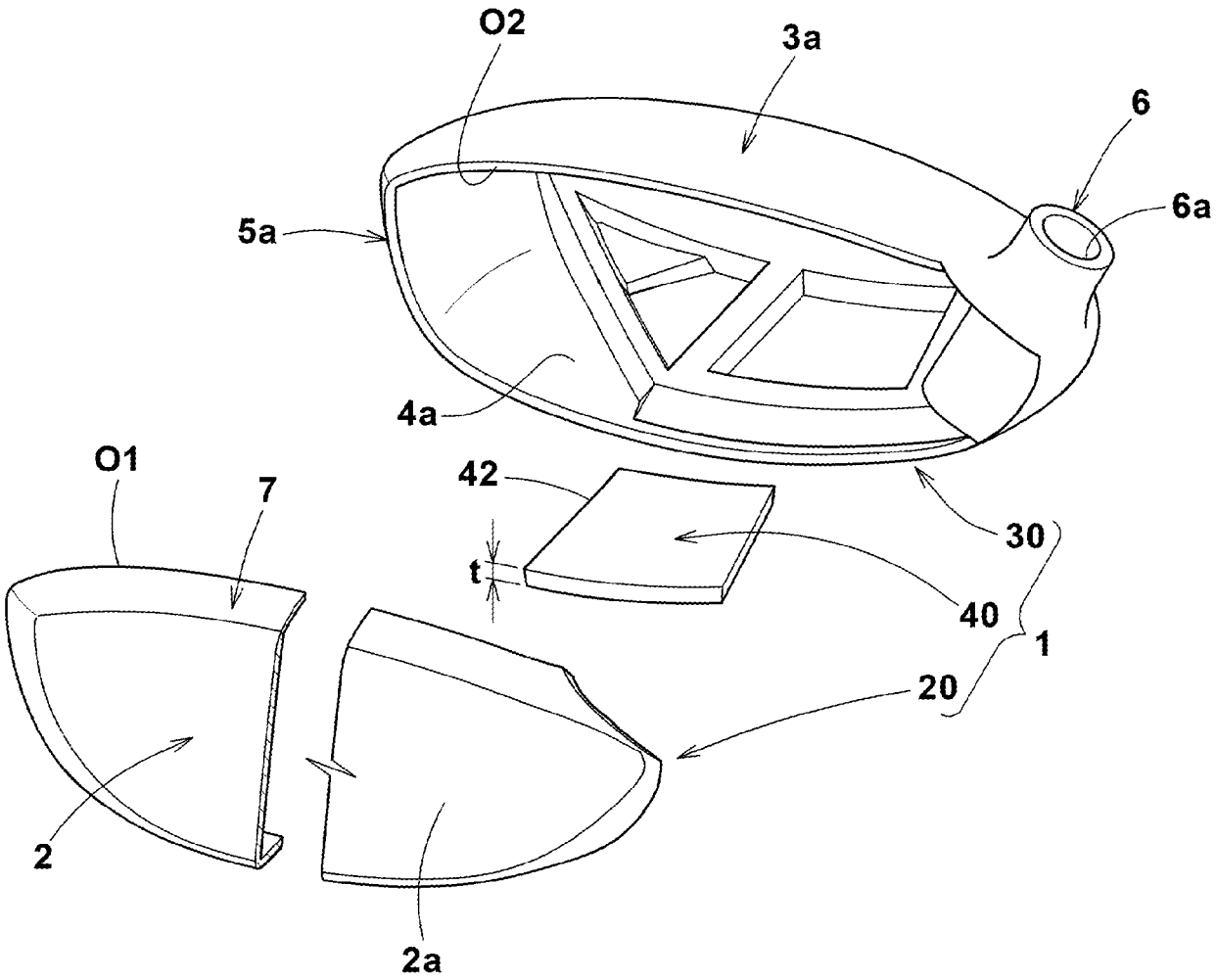
FIG. 5 is a perspective view of the golf club head of the embodiment before assembled.

The head main body 30 in this example has an opening in its front and is formed in a so-called cup shape as shown in FIGS. 3 to 5 although it is not limited to such a shape.

In this embodiment, the head main body 30 forms a major aft part of the head, and the face member 20 forms a fore part of the head.

The above-said opening is the only opening accessible to the inside of the head main body 30 in order to place the weight member 40 therein and to perform the welding operation.

The head main body 30 in this example is formed as a one-piece cast part made of a metal material. As the metal material, various materials, e.g. titanium, titanium alloy, stainless steel, aluminum alloy and the like can be employed. Preferably, a metal material which can be welded to the face member 20 is employed.

In this embodiment, the head main body 30 is made of the same metal material as the face member 20.

The head main body 30 in this example comprises a crown aft part 3*a*, a sole aft part 4*a* and a side aft part 5*a* which respectively constitute a major aft part of the crown portion 3, a major aft part of the sole portion 4, and a major aft part of the side portion 5, and the head main body 30 further comprises the neck portion 6. Thus, the head main body 30 constitutes a major aft part of the head 1 excluding the face member 20.

In this example, the face member 20 is fixed to the head main body 30 by welding the rear edge of the turnback 7 to the front edge of the head main body 30, aligning their openings O1 and O2 with each other.

As a result, there is formed the weld junction 32 (shown in FIGS. 1 to 3) extending in the toe-heel direction, passing through the crown portion 3, the sole portion 4 and the side portion 5.

In general, a weld junction becomes thicker than portions on both sides thereof and the rigidity is liable to become higher in the vicinity of the weld junction.

In the present embodiment, since the weld junction 32 is positioned away from the peripheral edge of the club face 2*a* toward the rear side, it is possible to prevent the rigidity of the face portion 2 from being increased by the presence of the weld junction 32. Consequently, rebound performance which the face member 20 can exert is not inhibited, and excellent rebound performance can be obtained.

This welding of the face member 20 and the head main body 30 is performed after the weight member 40 has been fixed to the head main body 30.

In order to obtain higher rebound performance, it is preferred that the turnback 7 has a length L1 in the front-back direction of the head (shown in FIG. 3) which is not less than 5 mm, more preferably not less than 7 mm, for example, although not particularly limited.

Further, in order to obtain higher rebound performance, it is preferred that the crown side turnback 7*a*, the sole side turnback 7*b*, the toe side turnback 7*c* and the heel side turnback 7*d* continue annularly in substance, excepting a part passing over the neck portion 6 as shown in FIG. 4 although not particularly limited.

The weight member 40 is fixed to the inner surface of the sole aft part 4*a* of the head main body 30 as shown in FIGS. 3 to 5.

The weight member 40 is made of a material having a specific gravity greater than that of the head main body 30 in order to lower the position of the center of gravity of the head 1.

Preferably, the mass of the weight member 40 is not less than 10% of the total mass of the face member 20 and the head main body 30. Thereby, a large mass is distributed to the sole portion 4, and the position of the center of gravity of the head 1 is further lowered.

As the material of the weight member 40, a high specific gravity metal material is suitably used.

specifically, alloys containing tungsten W, particularly tungsten-nickel-iron alloys containing W, Ni and Fe are preferably used.

Incidentally, the specific gravity of such alloy can be increased by increasing the proportion of W in its chemical composition.

The specific gravity of the weight member 40 is preferably not less than 7, more preferably not less than 8, still more preferably in a range from 10 to 15.

Figure 6:
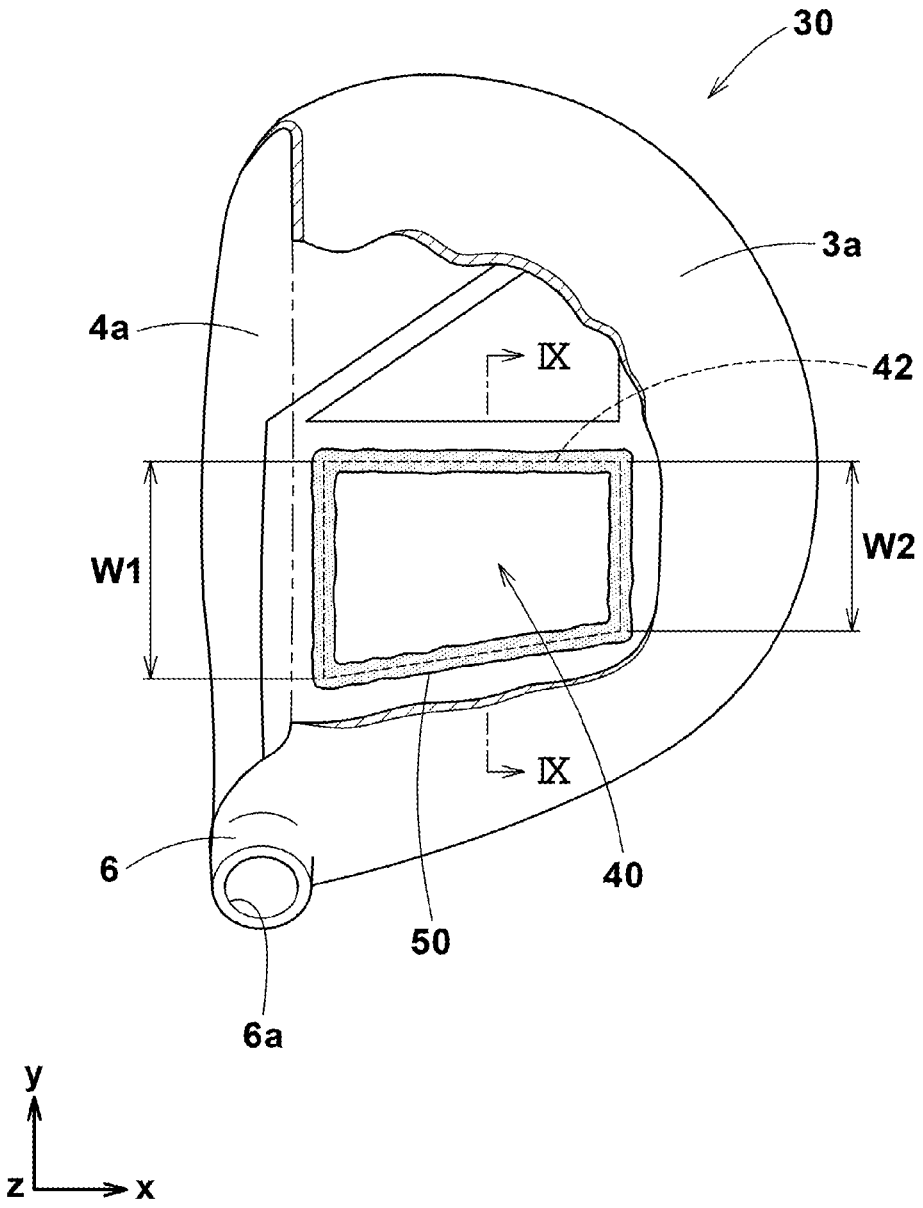
FIG. 6 is a plan view of the head main body of the golf club head of the embodiment.

FIG. 6 shows a plan view of the head main body 30 in which the crown aft part 3*a* is partially cut out.

As shown, the width in the toe-heel direction of the weight member 40 is such that the width W2 on the rear side is smaller than the width W1 on the front side.

Along the peripheral edge 42 of the weight member 40, there is formed a weld 50 for fixing the weight member 40 to the head main body 30.

That is, the weight member 40 is fixed to the head main body 30 by the use of the weld 50.

The weld (or weld bead) 50 is formed through a welding process in advance of the above-described process to fix the head main body 30 to the face member 20.

Figure 7:
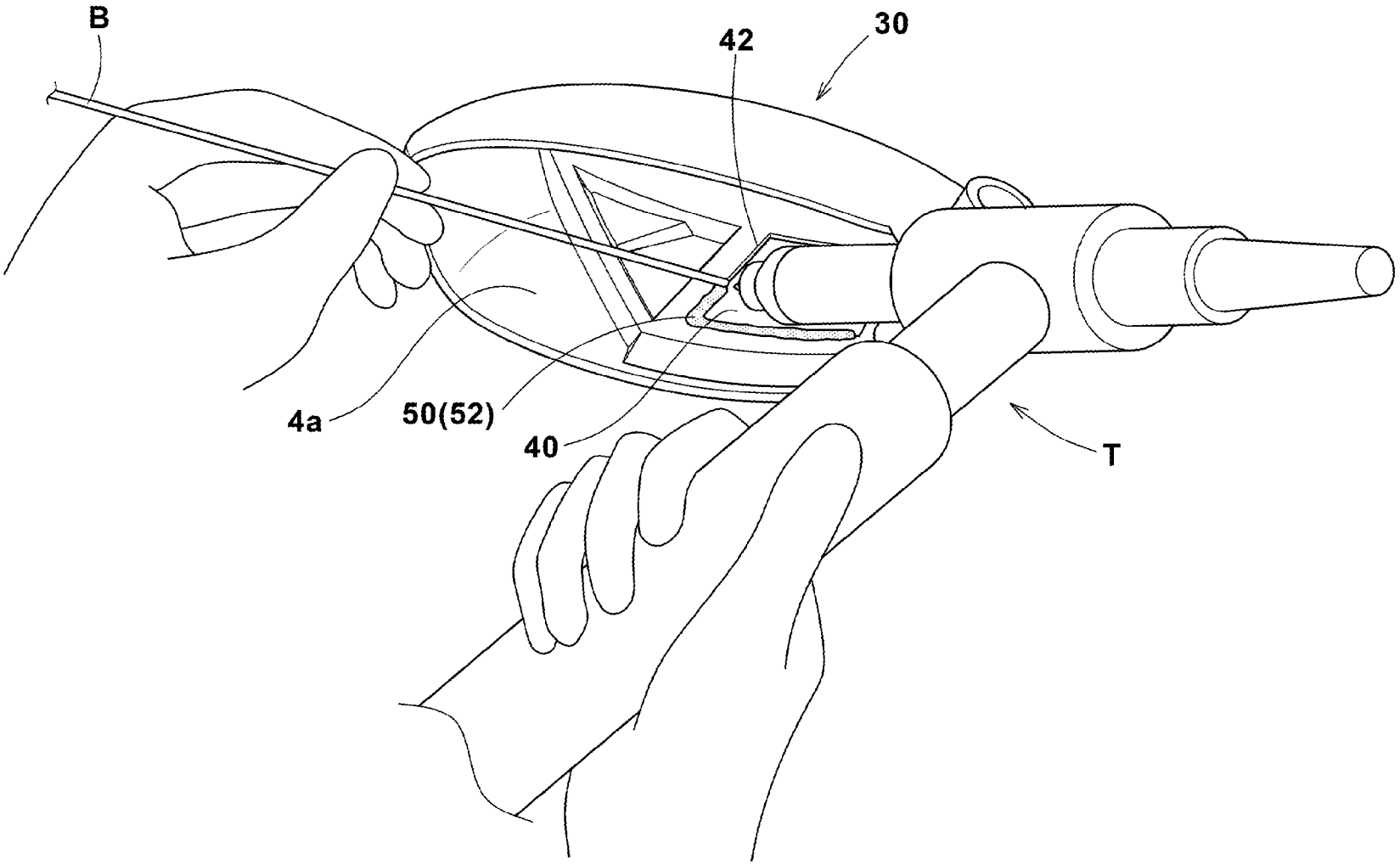
FIG. 7 is a perspective view illustrating the process of fixing the weight member to the inner surface of the head main body by using a welding torch.

An example of the welding process is shown in FIG. 7.

A suitable example of the welding process is TIG welding carried out by an operator.

In advance of the welding process, the weight member 40 is set on the inner surface of the sole aft part 4*a* of the head main body 30.

In the welding process, first, a welding torch T is inserted into the head main body 30 through the front opening of the head main body 30 by the operator.

Then, by applying the arc of the welding torch T to the peripheral edge 42 of the weight member 40, a molten weld pool is formed along the peripheral edge 42, while supplying a welding rod B thereto.

Thereby, the molten metal 52 is arranged continuously along the peripheral edge 42 of the weight member 40.

The molten metal 52 then become solidified and becomes the weld 50 (or weld bead).

Usually, the welding workability in a limited space in the cup-shaped head main body 30 is poor. But, by configuring the width of the weight member 40 as explained above, the welding workability is improved.

Namely, with respect to the width of the weight member 40, the width W2 on the rear side where the welding workability is poor is decreased, but the width W1 on the front side where the welding is relatively easily is increased, therefore, the welding workability is improved while securing a sufficient volume for the weight member 40.

Thus, in the golf club head 1 and its manufacturing method according to the present embodiment, it is possible to provide the golf club head 1 capable of achieving the improvement in the rebound performance and the lowing of the position of the center of gravity, without impairing the productivity.

The weight member 40 in this example has a trapezoidal shape with a pair of longer and shorter bases in its plan view, and the longer base defining the width W1 is positioned on the front side.

In this example, therefore, the width in the toe-heel direction of the head of the weight member 40 decreases continuously from the front side to the rear side.

Figure 8A:
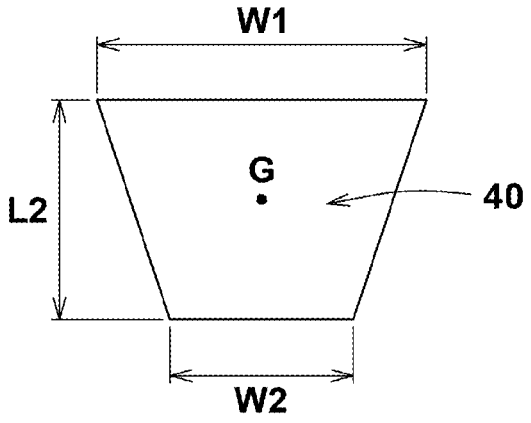
FIGS. 8A, 8B and 8C are plan views of examples of the weight member having various shapes.
Figure 8B:
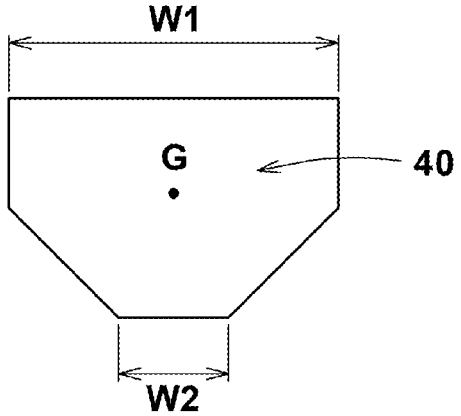
Figure 8C:
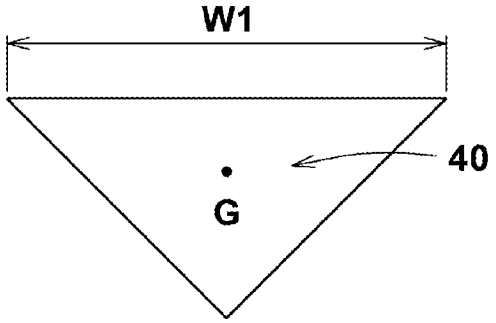

Aside from such trapezoidal shape, various shapes, for example as shown in FIGS. 8A, 8B and 8C may be employed as the shape of the weight member 40 in the plan view as far as the width W2 on the rear side is smaller than the width W1 on the front side.

The ratio of the width W2 to the width W1 is preferably not more than 0.9, more preferably not more than 0.8.

The width W2 on the rear side may be zero as shown in FIG. 8(C).

It is preferable that the shape of the weight member 40 in the plan view is substantially polygonal, made up of substantially straight sides. Thereby, in the welding process, the movement of the welding torch T becomes linear, and a stable operation is possible even by hand, so the workability by hand is improved.

If the number of the sides of the polygonal shape is too much, the workability is deteriorated although each side is straight. For this reason, the number of the sides is preferably 4 or 5. Incidentally, the weight member 40 having such substantially polygonal shape may be provided, at one or more corners formed between the substantially straight sides, with a small arc-shaped chamfer (for example, of a radius of curvature of about 5 mm) in the plan view since such chamfer does not deteriorate the welding workability.

On the other hand, as the weight member 40 disposed in the sole portion is increased in the width toward the club face from the rear side, the center of gravity G of the weight member 40 shifts forward. As a result, the position of the center of gravity of the head 1 is also shifts forward, keeping a lower position. Thus, the depth of the center of gravity of the head 1 from the club face 2*a* is decreased, while preventing the sweet spot of the club face 2*a* from becoming higher.

In order to lower the position of the center of gravity of the head 1, it is desirable to reduce the thickness t (shown in FIG. 5) of the weight member 40 as much as possible. Preferably, the weight member 40 is formed in the form of a thin plate having a substantially constant thickness (t) of not more than 10 mm, more preferably not more than 5 mm. Thereby, the center of gravity of the head 1 can be further lowered on the premise of the same mass.

In order to give an effective mass to the weight member 40, it is necessary for the weight member 40 to have a sufficient volume.

In order to satisfy the two requirements of reducing the thickness of the weight member 40 and securing a sufficient volume, the weight member 40 needs to have a larger area in the plan view. This tends to make the rear part 42*b* of the peripheral edge 42 of the weight member 40 be located further away from the front opening O2 of the head main body 30 toward the rear side.

Even in such configuration, however, according to the manufacturing method of the present embodiment, the deterioration of the productivity of the head 1 can be effectively suppressed.

Figure 9:
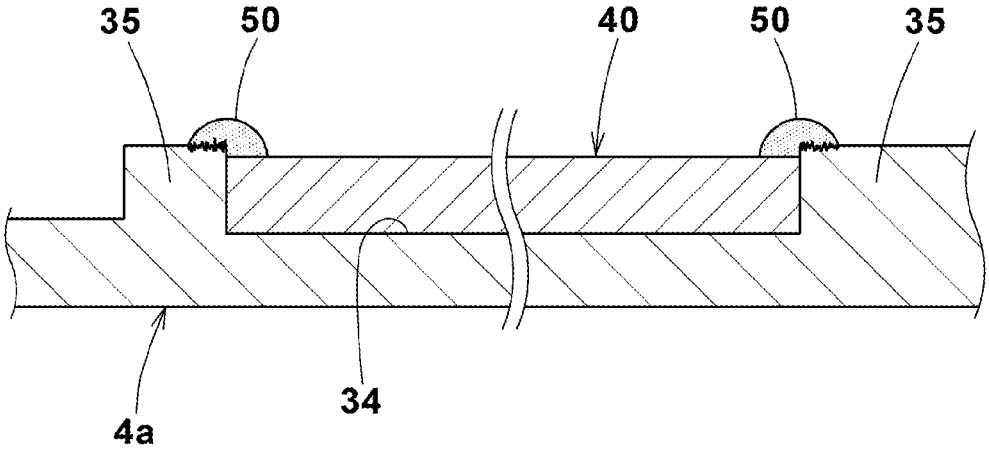
FIG. 9 is an enlarge cross-sectional view of the weight member placed in the recess taken along line IX-IX in FIG. 6.

FIG. 9 shows a cross section of the weight member 40 taken along line IX-IX in FIG. 6.

As shown, the weld 50 in this example is fused with the head main body 30, but not fused with the weight member 40. This is because weldability of the weight member 40 with the metal material constituting the weld 50, namely that of the welding rod B is poor due to the high content of tungsten W which is increased to increase the specific gravity of the weight member 40.

In this example, therefore, the weld 50 can restrain movements of the head in the front-back direction x, toe-heel direction y and up-down direction z, by its mechanical close contact with the surface of the weight member 40.

Preferably, the inner surface of the sole portion 4*a* of the head main body 30 is provided with a recess 34, and the weight member 40 is disposed in the recess 34 as shown in FIGS. 5 and 9.

The recess 34 in this example has a bottom and a surrounding wall 35 which define a space for accommodating the weight member 40, and the space has a slightly larger shape than that of the weight member 40 to exactly position the weight member 40.

In the present embodiment, the recess 34 is formed in a thick part of the sole portion 4*a* of the head main body 30. As shown in FIGS. 3 and 5, the thick part is formed to surround the recess 34 and protrude toward the inner cavity. In the head main body 30, the thickness of the thick part is largest, and the thickness of a crown portion of the head main body is smallest as shown in FIG. 3.

The thick part in this example is further provided on the toe side of the recess 34 with an additional recess in which no separate weight member is disposed.

And the dimension in the front-back direction of the head, of the thick part surrounding the additional recess becomes smaller, while extending toward the toe of the head and backward of the head. Thus, more weight is distributed toward the heel of the head at a lower position.

The weld 50 preferably extends from the sole portion 4*a* over the wall 35 onto the weight member 40. Thereby, from the upper side of the weight member 40, the weld 50 can restrain the movement of the weight member 40 in the up-down direction of the head.

Further, as the weld 50 in the state of molten metal has fluidity, and penetrates into and bridges the gap between the wall 35 and the weight member 40. Thereby, the backlash or movements of the weight member 40 in the front-back direction and the toe-heel direction of the head in relation to the head main body 30, can be restrained, and the occurrence of abnormal noise when hitting a ball is effectively suppressed.

Preferably, the upper edge of the wall 35 is higher than the upper surface of the weight member 40 in order to enhance the effect of the weld 50 restraining the movements of the weight member 40.

In order to facilitate the filling of the gap between the recess 34 and the weight member 40, it is preferred that a brazing material is placed on the surface of the recess 34 before the weight member 40 is placed in the recess 34. By the heat during the welding process, such brazing material is melted, flows and fills the gap, then solidifies, so the gap between the recess 34 and the weight member 40 can be further lessened.

Depending on the combination of the metal material of the head main body 30 and that of the weight member 40, the weld 50 can be fused with the head main body 30 as well as the weight member 40. In other words, the metal material of the weld 50 can be such a material that is weldable with both of the head main body 30 and the weight member 40.

Figure 10:
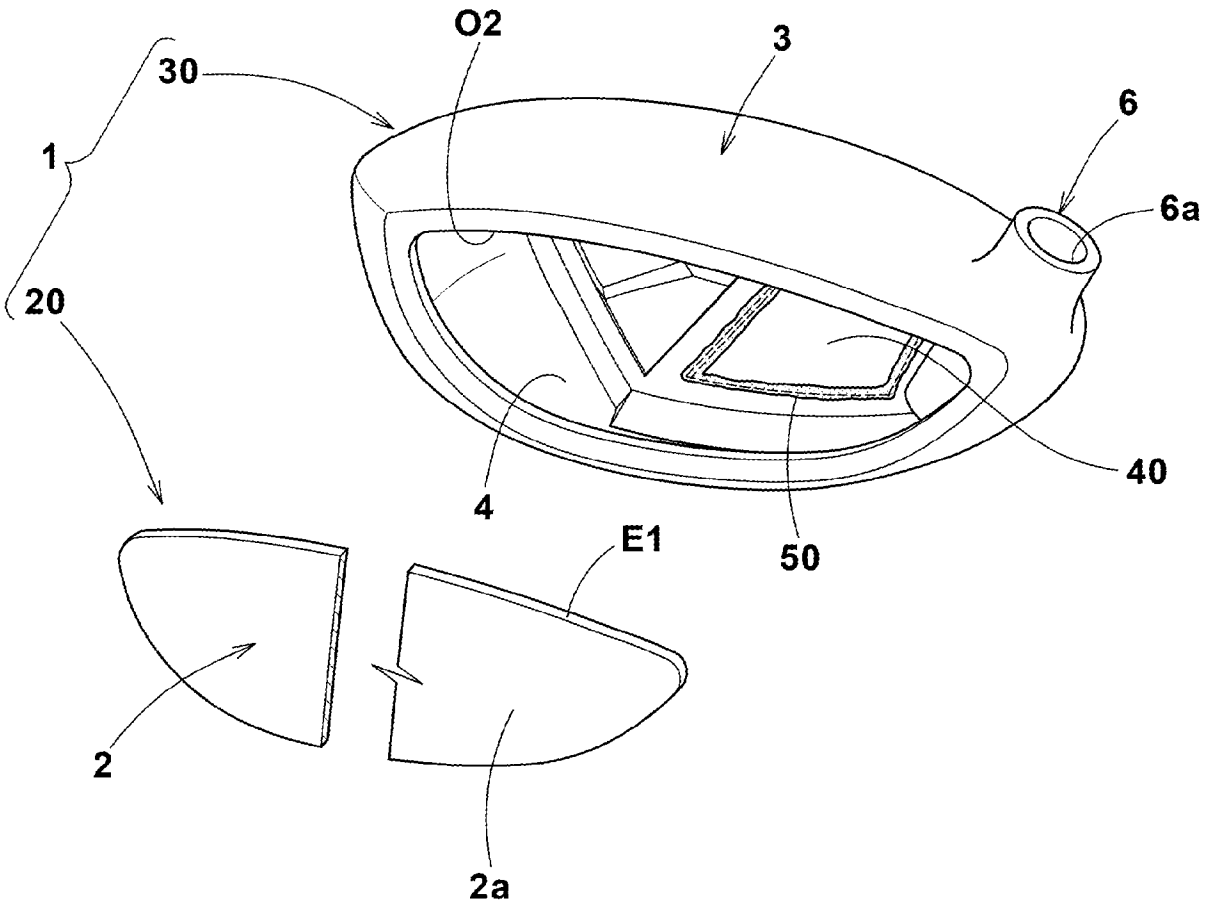
FIG. 10 is an exploded perspective view showing a golf club head as another embodiment of the present embodiment.

FIG. 10 shows an exploded perspective view of a golf club head 1 as another embodiment of the present invention. The differences from the former embodiment will be described, and redundant descriptions are omitted herein for clarity and conciseness by giving the same reference numbers to the parts/portions which perform the same or similar functions as in the former embodiment.

The golf club head 1 in this embodiment is also composed of a face member 20 and a head main body 30.

The head main body 30 in this embodiment is provided with a front opening O2 within the face portion 2 unlike the former embodiment.

The face member 20 is a flat or slightly curved plate without the turnback 7 unlike the former embodiment. The face member 20 constitutes a major part of the face portion 2. The contour shape of the face member 20 may be the same as the contour shape of the face portion 2, but in this embodiment, slightly smaller as shown in the figure.

The head main body 30 constitutes the remaining part of the head 1 excluding the face member 20.

The above-said front opening O2 is the only opening accessible to the inside of the head main body 30 in order to place the weight member 40 therein and to perform the welding operation.

In the case of a front opening like in this embodiment, the opening becomes smaller than that in the former embodiment, and the rear edge of the weight member becomes farther from the opening. Even so, according to the present invention, it is possible to prevent deterioration of the productivity.

Thus, the technical idea of the present invention can be applied to various golf club heads made using a head main body having an opening on its front side.

While detailed description has been made of especially preferable embodiments of the present invention, the present invention can be embodied in various forms without being limited to the illustrated embodiments.

1 golf club head
20 face member
30 head main body
34 recess
35 wall
40 weight member
50 weld

The invention claimed is:

1. A golf club head having an inner cavity and comprising a face member and a head main body having a front opening which are connected to each other, wherein the head main body comprises a sole portion, a weight member which has a specific gravity greater than that of the head main body is fixed to an inner surface of the sole portion, a weld which fixes the weight member to the sole portion of the head main body is formed at a peripheral edge of the weight member, and the weight member has the width in a toe-heel direction of the head, which is smaller on its rear side than its front side, wherein the weight member has a polygonal shape made up of substantially straight sides in a plan view of the weight member and the number of the sides is not more than five, the inner surface of the sole portion is provided with a recess in which the weight member is disposed, and the recess has a bottom and a surrounding wall which define a space for accommodating the weight member, and the space has a slightly larger shape than that of the weight member to exactly position the weight member.

2. The golf club head according to claim 1, wherein the weld which fixes the weight member to the sole portion of the head main body extends from the surrounding wall of the recess onto the weight member.

3. The golf club head according to claim 2, wherein, in a plan view of the weight member, the center of gravity of the weight member is positioned on a club-face side of a midpoint in the front-back direction of the head, of the weight member.

4. The golf club head according to claim 2, wherein the weight member has a trapezoidal shape having a pair of parallel long side and short side with the long side located on the club-face side in a plan view of the weight member.

5. The golf club head according to claim 1, wherein the mass of the weight member is 10% or more of the total mass of the face member and the head main body.

6. The golf club head according to claim 5, wherein, in a plan view of the weight member, the center of gravity of the weight member is positioned on a club-face side of a midpoint in the front-back direction of the head, of the weight member.

7. The golf club head according to claim 1, wherein the weight member has a trapezoidal shape having a pair of parallel long side and short side with the long side located on the club-face side in a plan view of the weight member.

8. The golf club head according to claim 1, wherein the upper surface of the surrounding wall is higher than the upper surface of the weight member.

9. The golf club head according to claim 8, wherein the weight member is formed in a plate shape having a thickness of not more than 10 mm.

10. The golf club head according to claim 9, wherein, in a plan view of the weight member, the center of gravity of the weight member is positioned on a club-face side of a midpoint in the front-back direction of the head, of the weight member.

11. The golf club head according to claim 8, wherein the recess is formed in a thick part of the sole portion of the head main body, and the thick part surrounds the recess and protrudes toward the inner cavity so as to form the surrounding wall.

12. The golf club head according to claim 11, wherein the thick part is further provided, on a toe side of the recess, with a second recess in which no separate weight member is disposed.

13. The golf club head according to claim 12, wherein the dimension in a front-back direction of the head, of the thick part surrounding the second recess becomes smaller, while extending toward the toe of the head and backward of the head.

14. The golf club head according to claim 13, wherein in the head main body, the thickness of the thick part is largest, and the thickness of a crown portion of the head main body is smallest.

15. A golf club head having an inner cavity and comprising:

a head main body having a front opening and comprising a sole portion, a face member connected to the head main body, and a weight member having a specific gravity greater than that of the head main body and fixed to an inner surface of the sole portion, wherein the weight member has the width in a toe-heel direction of the head, which is smaller on its rear side than its front side, wherein the inner surface of the sole portion is provided with a recess in which the weight member is disposed, the recess has a bottom and a surrounding wall which define a space for accommodating the weight member, a weld which fixes the weight member disposed in the recess to the sole portion is formed at a peripheral edge of the weight member and extends from the surrounding wall onto the weight member, and at least part of the surrounding wall where a part of the weld is formed, is higher than the weight member where a part of the weld is formed.

16. The golf club head according to claim 15, wherein the thickness of the sole portion measured at the bottom of the recess is smaller than the thickness of the sole portion measured at a position outside the surrounding wall.

17. The golf club head according to claim 16, wherein the thickness of the sole portion measured at said at least part of the surrounding wall is larger than said thickness of the sole portion measured at said position outside the surrounding wall.

* * * * *